United States Patent [19]

Gottfried et al.

[11] 3,971,966

[45] July 27, 1976

[54] PLANAR RING BAR TRAVELLING WAVE TUBE

[75] Inventors: Arthur H. Gottfried, Rumson; Louis J. Jasper, Jr.; John J. Tancredi, both of Neptune, all of N.J.

[73] Assignee: The United States of America as represented by the Secretary of the Army, Washington, D.C.

[22] Filed: Aug. 14, 1975

[21] Appl. No.: 604,737

[52] U.S. Cl. ..... 315/39.3; 315/3.5; 315/4; 330/43

[51] Int. Cl.[2] ..... H01J 25/34

[58] Field of Search ..... 315/3.5, 3.6, 4, 5, 315/39.3; 330/43

[56] References Cited

UNITED STATES PATENTS

| | | | |
|---|---|---|---|
| 2,617,961 | 11/1952 | Bruick | 315/3.5 |
| 2,654,004 | 9/1953 | Bailey | 315/4 |
| 2,717,327 | 9/1955 | Touration et al. | 315/3.5 |
| 3,305,752 | 2/1967 | Friz | 315/5 X |
| 3,610,998 | 10/1971 | Falce | 315/3.5 |
| 3,654,509 | 4/1972 | Scott et al. | 315/3.5 |
| 3,746,915 | 7/1973 | Jasper, Jr. | 315/3.6 |

*Primary Examiner*—Saxfield Chatmon, Jr.
*Attorney, Agent, or Firm*—Nathan Edelberg; Sheldon Kanars; Daniel Sharp

[57] ABSTRACT

This invention concerns a traveling wave amplifier of pillbox configuration that can be made for battery operation. It has a high perveance cylindrical electron gun between closely spaced, parallel, flat surfaces of a pair of thin ceramic disks sealed at their perimeters to a conductive collector ring coaxial with the electron gun. One or both of the disks support a novel planar slow wave circuit. The slow wave circuit is termed a ring-bar circuit but differs from cylindrical ring-bar structures. It includes a series of concentric conductive rings. Along one diameter of the rings, to one side of the center of the rings, the first and second, third and fourth, fifth and sixth rings, etc., are conductively connected, and to the other side of the center of the rings, the second and third, fourth and fifth, sixth and seventh rings, etc., are conductively connected. RF feed connections are made to the first and last rings of the slow wave circuit opposite their connections to the second and next to last rings, respectively. A ring-bar circuit is printed on the inside surface of one or both of the ceramic disks or is constructed of wire and ribbon and is supported by the disk(s). If only one disk supports a ring-bar circuit, the other disk carriers a flat annular conductor of the same inner and outer diameters as the ring-bar circuit. If needed, focusing magnets are supported contiguous the outer surfaces of the disks. This invention can be made for operation with band-width as low as 2% and at high efficiency.

10 Claims, 4 Drawing Figures

PLANAR RING BAR TRAVELLING WAVE TUBE

BACKGROUND OF THE INVENTION

In any forward traveling wave tube amplifier device, a beam of electrons gives up energy to a high frequency RF signal to amplify the signal. The RF signal is propagated by a slow-wave structure with a phase velocity that is a fraction of the free space velocity of the RF. The beam of electrons is propelled into the region of the slow RF wave, in the same direction as the propagation direction of the slow RF wave, and at essentially the same speed. Before entering the region of the slow RF wave, the electron beam is accelerated by the electron gun to the slow-wave phase velocity. The electron beam and the slow-wave interact in that region. During interaction between the beam electrons and the propagated slow-wave, interacting electrons are velocity-modulated causing bunching of electrons along the transiting beam and a general slowing of the beam. To maintain synchronism of electron beam and slow-wave through the interaction region, the slow-wave circuit is designed for slowing progress of the slow-wave along the interaction region. When operating conditions are proper there is maximum transfer of energy from the electron beam to the RF signal. The conducted signal is amplified and gain is related to the length of the interaction region in wavelengths and to the current density of the electron beam that interacts with the propagated slow-wave.

U.S. Pat. No. 3,781,702 issued to Louis J. Jasper, Jr., coinventor in this application, discloses a traveling wave tube that includes an electron gun supported between and coaxial with parallel ceramic disks that are sealed at their perimeters to a conductor ring coaxial with the electron gun. A slow-wave circuit, in the form of a conductor spiral, is printed on an inner surface of one or both of the disks. The amplifier operates wide band. There is need for traveling wave amplifiers for use in expendable jammers or other expendable high frequency electronic equipments. Such expendable single-use amplifiers should be low cost and of comparatively simple structure. For use in a missile, it is necessary to restrict weight and size. Therefore, there is need for a traveling wave amplifier that is as lightweight and compact as possible. For compatibility with battery power available in expendable equipments, the amplifier should be operable at low voltage, and be low power, and efficient. Also there is need for improved modulator and amplifier devices for use in place on phased array antenna assemblies. Additionally, consumer items such as microwave ovens need lower-voltage, higher-current, more economical traveling-wave amplifiers.

SUMMARY OF THE INVENTION

This invention concerns a very narrow band, relatively low voltage, highly efficient traveling wave amplifier that has a high perveance cylindrical electron gun between closely spaced, parallel, flat surfaces of a pair of ceramic disks sealed at their perimeters to a collector ring coaxial with the electron gun. At least one of the inner flat surfaces has a printed slow-wave circuit that includes concentric rings. Though the printed slow-wave circuit is preferred, the slow-wave circuit(s) may be constructed of wire rings and ribbon connecting bars. Looking outward in one direction from the center of the concentric rings, there are in-line conductive connections between the first and second rings, third and fourth rings, etc.; looking outward in the diametrically opposite direction from the axis of the rings, there are in-line conductive connections between the second and third rings, the fourth and fifth rings, etc. This invention can be included in a phased array antenna to serve as an amplifier in place on the array; in such array there is an amplifier for each antenna element. Also, the invention lends itself to very narrow band design. For high power or frequencies below about 8GHz, the amplifier includes magnetic focusing elements. This invention is of major advantage in a system where a low-cost low-voltage tube are primary considerations.

DESCRIPTION OF THE PREFERRED EMBODIMENT

Figure 1:
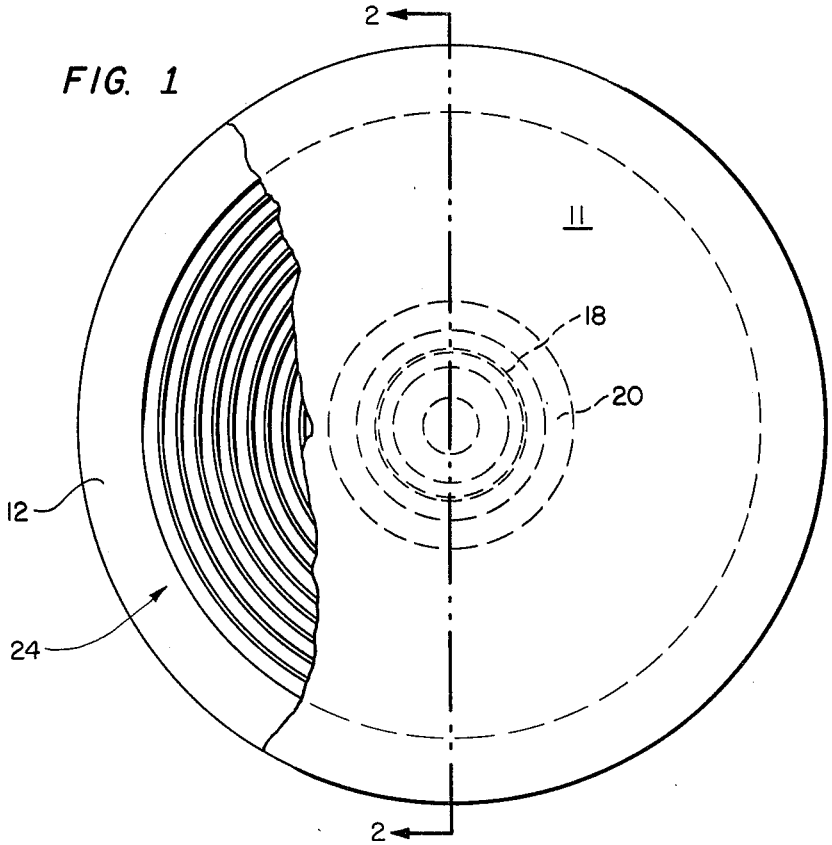
FIG. 1 is a plan view partly broken away of an embodiment of the invention, not including flat outer conductor shields as in FIG. 2, nor magnetic focusing elements.
Figure 2:
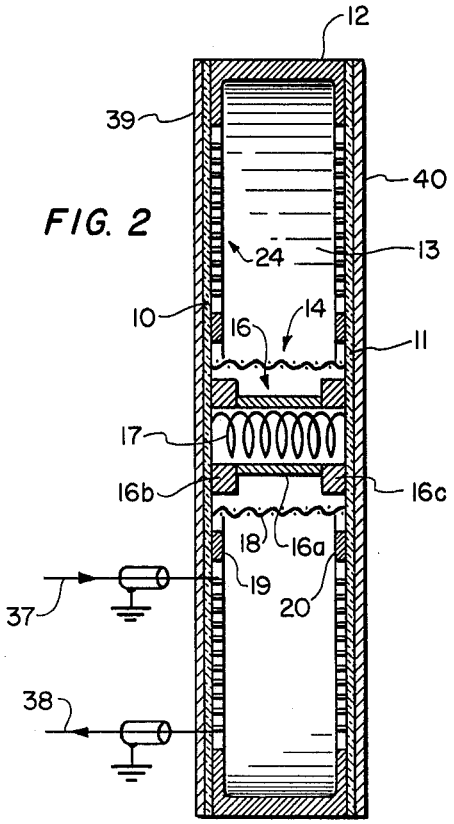
FIG. 2 is a section taken along line 2—2 of FIG. 1.
Figure 3:
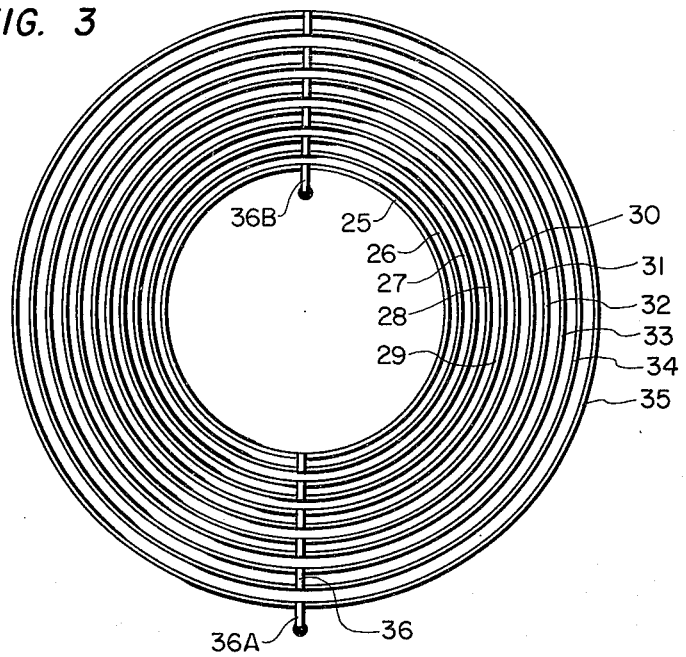
Figure 4:
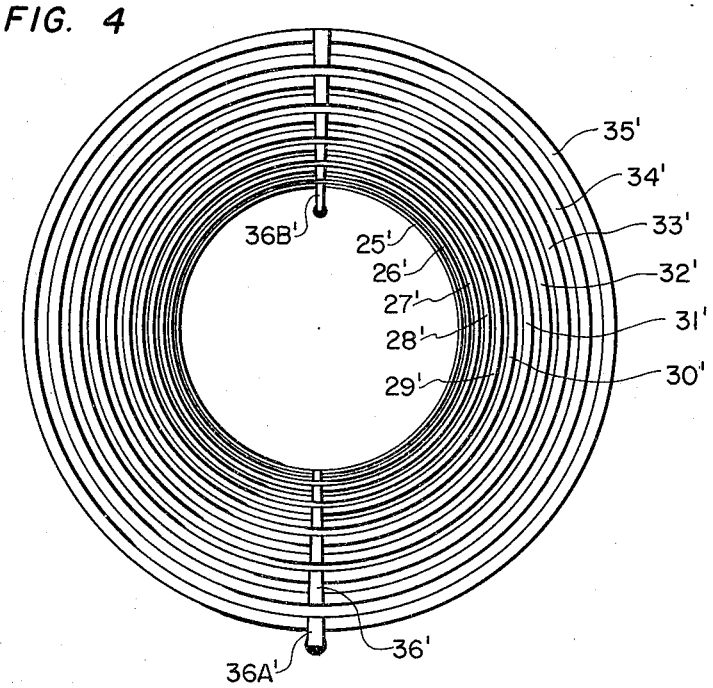

FIG. 3 is a plan view of a printed ring-bar slow-wave circuit according to this invention including bars of constant lengths and rings and space widths of uniform size; and FIG. 4 is a plan view of a printed slow-wave circuit according to this invention including bars that increase in length and width with increased distance from the center and with rings and spaces of increasing width with increased distance from the center.

The preferred embodiment of traveling wave tube shown in the drawings has a pillbox configuration as is disclosed in U.S. Pat. No. 3,781,702. More particularly, it includes a pair of flat, circular, parallel dielectric plates 10, 11 of alumina ceramic or other suitable dielectric material and a conductor collector ring 12 of approximately the same outside diameter sealed to both plates 10 and 11 and together confining a vacuum chamber 13. The spacing between plates 10 and 11 is related to the power rating and frequency. About three-eighths inch is the minimum spacing for a low power amplifier operating at C band (500–1000 MC). A cylindrical electron gun 14 is supported between the plates and in part on the plates, coaxial with collector ring 12 for emitting a high perveance sheet beam radially over fully 360° around the electron gun. Electron gun 14 includes a cathode 16, a heater coil 17 within the cathode, a control electrode 18 in the form of a cylindrical wire grid surrounding the cathode, and identical in-line accelerating anode rings 19, 20 printed on the two plates and surrounding the ends of electrode 18. Anode rings 19, 20 are connected in common by exterior wiring, not shown. Cathode 16 includes a circular cylinder **16*a* of emitting material with non-emitting conductive circular flanges 16*b* and 16*c* at its ends; the presence of flanges 16*b* and 16*c* at the same potential as the emitting cylinder 16*a* shields against emission from the emitting cylinder ends directly toward the plates 10 and 11. Diameter and length of the cathode are designed so that the cathode surface area is large enough to emit the required beam current. Control electrode 18 is a non-intercepting wire grid or formed of very thin wire with comparatively large spaces to present minimal obstruction to the electron beam. The cathode 16, control electrode 18, and accelerating anodes 19, 20 are coaxial with one another and with the collector ring 12; direct current power supply means for and its connections to these elements are omitted from the drawing. Also, AC or DC power supply means and connections to the heater 17 are not included in the drawing. The collector ring 12 is channel-shaped in cross section. Two advantages of the channel-shape of collector ring 12 is that it captures some of the beam electrons that might otherwise strike the plates 10, 11 and that the collector is heat-sinked by the plates 10, 11.**

The choice of electrodes and the number of electrodes in the electron gun and their design are not part of this invention. While the electron gun requires an accelerating anode, the inclusion of control electrode 18 or additional electrodes, not shown, for beam shaping or for additionally accelerating the beam are design choices. In the disclosed embodiment, the wire grid electrode 18 can be used for switching, modulating, or accelerating the beam. Printed anodes 19, 20 may be replaced by a second wire grid electrode; control electrode 18 may be replaced by additional pair of printed annular electrodes coaxial with printed anodes 19 and 20. For high-current, low-voltage operation the electron beam has a micro-perveance on the order of fifty.

A ring-bar slow-wave propagation circuit means 24 is printed on the inner surface of at least one of the dielectric plates 10, 11 between the electron gun and the collector ring and as shown in FIG. 3 includes a series of closed concentric rings exemplified by the eleven rings 25 through 35 inclusive. In simplest form, the radial thicknesses of the rings are equal and the radial spacings between rings are equal. The rings are coaxial with the electron gun 14 and with the collector ring 12. A series of ribbon-like conductor bars 36 connect the rings 25 and 26, 27 and 28, 29 and 30, 31 and 32, 33 and 34, 33 and 32, 31 and 30, 29 and 28, and 27 and 26 along a diametral line. Penetrating the dielectric plate 10 and sealed therein are conventional coaxial connections 37, 38 to the outermost bar 36A and to the innermost bar 36B shown in FIG. 3; impedance matching means are not shown. One dielectric plate is provided with a printed flat annulus of conductive material of the same inner and outer radial dimensions as the slow-wave circuit 24. Alternatively both plates are provided with identical ring-bar circuits oriented so that the bar elements 36 of both ring-bar circuits are symmetrical relative to a common diametral plane and either are in mirror image relationship or are relatively displaced 180°. The latter structural arrangement inhibits higher order modes.

As an alternative to printed ring-bar circuit means, the slow-wave circuit may be formed of conductive wire in a circular or ribbon form. The structure is flat and is carried by at least one of the plates 10, 11 between collector 12 and electron gun 14.

There is a conductive connection not shown between the slow-wave circuit 24 and the opposed conductor annulus or in the alternative with the opposed slow-wave circuit; during operation they are at a common potential relative to the cathode so that essentially all of the beam passes through a substantially equipotential field in the interaction region. The small percentage of beam electrons that strike the plates 10, 11 return through the ring-bar circuits or through the conductor annulus and one ring-bar circuit. There is no significant accumulation of electric charge on the dielectric plates 10, 11.

As beam electrons transit radially outward, beam current density decreases with the effect of counteracting the tendency to debunching and the accompanying degradation in gain as the electron beam transfers energy to the RF wave in the interaction region. This factor decreases the focusing problem. The axial length of the collector ring 12 and thus the spacing of the plates 10, 11 is as small as possible, consistent with the cathode emitting area required in order that as large a percentage of the beam current as possible interacts with the propagated slow-wave. Though interaction occurs close to the slow-wave circuit, spacing is wide enough so that in operating at low voltage, the percentage of beam current that strikes the plates 10, 11 is not excessive.

For low power and/or high frequency operation, neither magnetic nor electrostatic focusing is needed, provided the diameter of collector ring 12 is limited to a few inches and the electron gun electrodes are properly shaped. If beam focusing is needed in the interaction region to resist beam spreading because the beam current level is high or because frequency is relatively low and thus beam transit distance is relatively long, focusing is provided by periodic permanent magnets (PPM), not shown, contiguous with the outer face(s) of the traveling wave tube. The PPM may be formed as a washer-like flat annulus of about the same inside and outside diameters as the slow-wave circuit of a ceramic matrix with concentric magnetic rings supported by the matrix, the successive magnetic rings having opposite directions of polarization, normal to the PPM annulus. The thicknesses of the PPM ring magnets is made such that the beam is exposed to a nearly uniform magnetic field. The PPM focusing arrangement requires matching impedance means which is printed on the plates 10, 11. DC and RF connections are brought out through holes in the PPM structure.

When a high frequency RF signal is coaxially coupled into the innermost bar and out of the outermost bar of the printed slow-wave circuit there is radially propagated a forward slow-wave with phase velocity that is a fraction of the free space velocity, and with a substantially circular wave-front. The electron beam is propelled in the same direction as the slow-wave and at essentially the same velocity. The electron beam is accelerated by the electron gun to the slow-wave phase velocity before introduction into the interaction region. During interaction between the beam electrons and the propagated slow-wave, interacting electrons are velocity-modulated causing bunching of electrons along the transiting beam and a general slowing of the beam. When operating properly, there is a transfer of energy from the electron beam to the signal, amplifying the signal. The amplifier gain is related to the length of the interaction region in wavelengths and to the beam current density that interacts with the propagated slow-wave.

Each ring has left-hand and right-hand current paths relative to its ring-bar junction. The mode generated may be considered to arise from the superposition of the fields due to two single conductors carrying current in opposite directions. The superposed fields may be in phase or in antiphase and correspond to symmetric and antisymmetric modes. This invention is a forward wave amplifier and uses the symmetric mode. Interaction impedance is large because the useless TE component of the fundamental mode is suppressed; essentially all the energy is in the TM mode. Also interaction impedance is high because the conducting bars cause the RF energy to be concentrated in a narrow frequency band.

Thus the invention has medium high power applications. The ring-bar structure has periodic loading and is highly dispersive. Phase velocity varies with frequency. The relationship between velocity of the electron beam and the RF wave propagated by the slow-wave circuit is a function of frequency. There is an optimum frequency for maximum gain and efficiency. Above and below the optimum frequency gain falls rapidly due to variations in impedance and electrical length of the circuit with frequency and due to the electron beam falling out of synchronism with the propagated slow-wave. This is the dominant characteristic of the ring-bar circuit contributing to narrow band and high efficiency.

If the traveling wave amplifier is designed for considerable gain and the radial dimension of the ring-bar circuit is many wavelengths long, the radial widths of the rings and the lengths of the bars are made such that the electron beam and the slow-wave remain in synchronism in the desired bandwidth. To maintain the synchronism between propagated slow-wave in the desired bandwidth and interacting electron beam, the lengths of the bars increase progressively from the center. In high gain tubes, the widths of the rings 25' through 35' and the widths of the bars 36' increase with distance from the center for increased current capacity. This is illustrated in FIG. 4.

In radial interaction amplifier according to this invention, the only symmetrical mode that is set up is the N=0 mode, which has circular wavefronts; there is accumulative interaction only in this mode. Therefore, higher harmonics are less troublesome in this invention than in conventional traveling wave tubes.

With bars of varying length $$v\rho = \frac{\rho - \rho_o}{t}$$

where $v\rho$ is phase velocity $\rho$ is the inner radius of the largest ring $\rho_o$ is the inner radius of the smallest ring $t$ is wave energy transit time across the slow-wave circuit. The velocity of the wave circumferentially around the ring-bar circuit equals approximately the velocity of light in free space and is approximated as follows:

$$c \approx \pi \left(\frac{\rho + \rho_o}{2}\right) \frac{N}{t}$$

where $$\left(\frac{\rho + \rho_o}{2}\right)$$

is the average radius

N is the number of rings $t$ is the time required for conduction of the signal energy through the ring-bar circuit.

Therefore $$\frac{v\rho}{c} = \frac{\rho - \rho_o}{\pi \left(\frac{\rho + \rho_o}{2}\right) N}$$

If $S_{AV}$ is the average spacing between rings, then $$N = \frac{\rho - \rho_o}{S_{AV}} + 1$$

If the spacing between rings is made proportionate to radius, the spacing between any two rings is $$S\rho = K\rho + S_o$$

where K is a proportionality constant $S_o$ is the spacing between innermost two rings Therefore $$S_{AV} \approx \frac{S\rho + S_o}{2}$$

Therefore by substitution $$N = \frac{\rho - \rho_o}{\frac{S\rho}{2} + \frac{S_o}{2}} + 1$$

Since $$\frac{S\rho}{2} = \frac{K\rho}{2} + \frac{S_o}{2}$$

Then $$N = \frac{\rho - \rho_o}{\frac{K\rho}{2} + S_o} + 1$$

For $$\rho >> \rho_o \text{ and } N >> 1$$

$$N \approx \frac{\rho - \rho_o}{\frac{K\rho}{2} + S_o}$$

Then $$\frac{N\rho}{c} \approx \frac{\rho - \rho_o}{\pi \left(\frac{\rho + \rho_o}{2}\right) \left(\frac{\rho - \rho_o}{\frac{K\rho}{2} + S_o}\right)} = \frac{K + 2\frac{S_o}{\rho}}{\pi \left(1 + \frac{\rho_o}{\rho}\right)}$$

For $$\rho >> S_o \; \rho >> \rho_o$$

$$\frac{v\rho}{c} = \frac{K}{\pi}$$

But $$K = \frac{\Delta\rho}{\rho}$$

where $\Delta\rho$ is the radial difference between two successive rings of $\rho_1$ and $\rho_2$ Since $$K + 1 = \frac{\Delta\rho}{\rho} + 1 = \frac{\Delta\rho + \rho}{\rho} = \frac{\rho_2}{\rho_1}$$

Therefore $$\frac{\nu\rho}{c} \approx \frac{1}{\pi}\left(\frac{\rho_2}{\rho_1} - 1\right)$$

Also $$\frac{\nu\rho}{c} = \frac{\sqrt{V}}{500}$$

where $V$ = accelerating voltage and $\nu\rho$ and c are in MKS units.

$$\frac{\sqrt{V}}{500} \approx \frac{1}{\pi}\left(\frac{\rho_2}{\rho_1} - 1\right)$$

$$V \approx \frac{25\times10^4}{\pi^2}\left(\frac{\rho_2}{\rho_1} - 1\right)^2$$

The above equation gives the approximate voltage condition for operation of the device when the spacings between rings are proportional to the radius.

The traveling wave tube amplifier described radiates energy when the circumference of the amplifier is equal to $4\lambda_o$ where $\lambda_o$ is free space wavelength of the frequency of operation. Copper shields 39, 40 are secured to the outer surfaces of the plates 10, 11 under the PPM, if any, to prevent radiation from the amplifier and to extend its high frequency limit. Lower frequency cutoff of the amplifier is determined by the effective electrical length of the ring-bar circuit.

What is claimed is:

1. A pill box shaped traveling wave tube comprising an electrically conductive annular collector, an electron gun including a cathode positioned coaxial with said collector for providing a radial electron beam, and a slow-wave circuit disposed between said cathode and said collector, said slow-wave circuit being a ring-bar structure having a plurality of closed concentric coplanar rings of differing radii coaxial with said cathode and said collector and positioned adjacent at least one of two transverse boundaries of said radial beam, said slow-wave circuit further including a plurality of radially disposed electrically conductive bars, adjacent ones of said rings being connected only by a single one of said radial bars, and successive bars being angularly disposed relative to one another.

2. A traveling wave tube according to claim 1 wherein said slow-wave circuit consists of two distinct identical coplanar ring-bar structures disposed adjacent opposite transverse boundaries of said radial beam.

3. A traveling wave tube according to claim 1 wherein said bars are disposed along a diametral line of said tube.

4. A traveling wave tube according to claim 1 wherein the angular disposition of said successive bars is 180°.

5. A traveling wave tube according to claim 1 wherein the width of said rings and said bars and the space between adjacent rings are uniform.

6. A traveling wave tube according to claim 1 wherein the width of successive rings and successive bars and the spacing between successive rings change with increasing radius of said tube.

7. A traveling wave tube according to claim 2 wherein the bars of both said coplanar ring-bar structures are in alignment.

8. A traveling wave tube according to claim 1 further including a pair of circular dielectric plates of substantially the same diameter as said collector sealed to and spaced apart by said collector, said slow-wave circuit being carried by the inner surface of at least one of said dielectric plates.

9. A traveling wave tube according to claim 8 wherein said slow-wave circuit is a printed circuit.

10. A traveling wave tube according to claim 9 wherein one of said dielectric plates carries only an annular electrically conductive layer juxtaposed to said radial beam.

* * * * *